US006829862B1

(12) United States Patent
Skulsky

(10) Patent No.: US 6,829,862 B1
(45) Date of Patent: Dec. 14, 2004

(54) PERGOLA END CAP

(76) Inventor: Bryan S. Skulsky, 255 Hillcrest Rd., Marshfield, MA (US) 02050

( * ) Notice: Subject to any disclaimer, the term of this patent is extended or adjusted under 35 U.S.C. 154(b) by 0 days.

(21) Appl. No.: 10/364,447

(22) Filed: Feb. 11, 2003

Related U.S. Application Data

(60) Provisional application No. 60/356,521, filed on Feb. 13, 2002.

(51) Int. Cl.[7] ..... E04D 13/64

(52) U.S. Cl. ..... 52/95; 52/287.1; 52/741.1

(58) Field of Search ..... 52/95, 94, 82, 52/287.1, 300, 716.1, 741.1, DIG. 8

(56) References Cited

U.S. PATENT DOCUMENTS

| | | | | | |
|---|---|---|---|---|---|
| 3,260,022 | A | * | 7/1966 | Guyer et al. | 52/86 |
| 5,711,123 | A | * | 1/1998 | Lamont et al. | 52/287.1 |
| 2003/0041531 | A1 | * | 3/2003 | Seldon | 52/94 |
| 2003/0115813 | A1 | * | 6/2003 | Wong Hahn | 52/288.1 |
| 2003/0226327 | A1 | * | 12/2003 | Perry | 52/287.1 |

* cited by examiner

*Primary Examiner*—Ramon O Ramirez
(74) *Attorney, Agent, or Firm*—John P. McGonagle

(57) ABSTRACT

A shaped, decorative pergola vinyl end cap and end piece, a method of shaping pergola vinyl component ends, and a portable tool used for shaping pergola vinyl component ends.

5 Claims, 7 Drawing Sheets

PERGOLA END CAP

RELATED U.S. APPLICATION DATA

This application claims the benefit of Provisional Application 60/356,521, filed Feb. 13, 2002.

BACKGROUND OF THE INVENTION

This invention relates generally to pergolas, and more particularly to pergola end caps.

Prior art pergolas have generally been made from wood or metal. Wood and metal are adversely affected by weather, structurally and aesthetically deteriorating over time. To overcome the weather limitations of prior art materials, vinyl is becoming a popular substitute material. Vinyl provides the structural and aesthetic qualities of prior art materials with the added advantage of being nearly impervious to the effects of weather.

The vinyl components used in constructing pergola structures are pre-made rigid extrusions. Vinyl extrusions have generally hollow, rectangular shapes. End caps are required to finish protruding pergola ends. Prior art vinyl end caps have been flat pieces. Aesthetically, it is desirable to have shaped pergola ends, especially if decorative ends are desired in the pergola structure.

SUMMARY OF THE INVENTION

The present invention provides a shaped, decorative pergola vinyl end cap, a method of shaping pergola vinyl component ends, and a portable tool used for shaping pergola vinyl component ends.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 3:
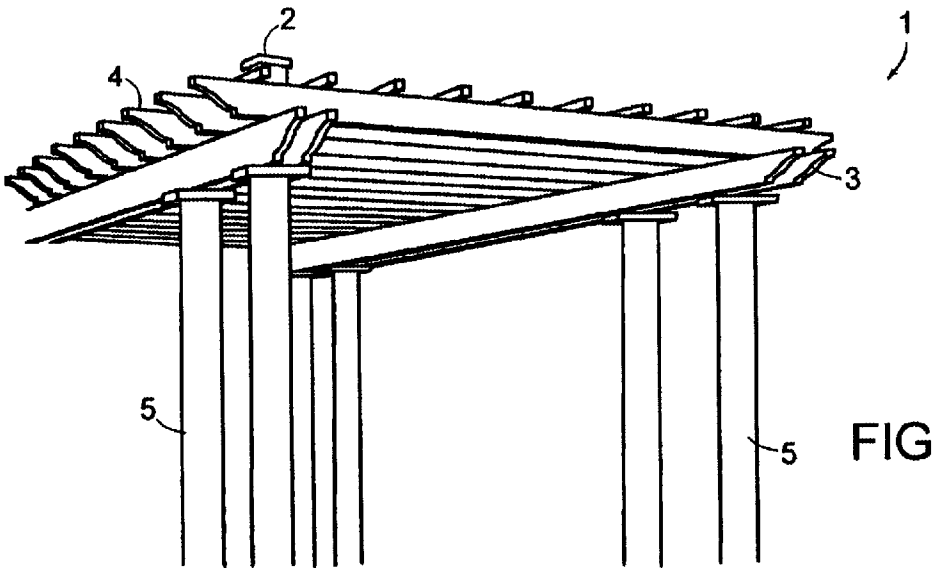
FIG. 3 is a perspective view, partly in section, of a pergola structure.
Figure 4:
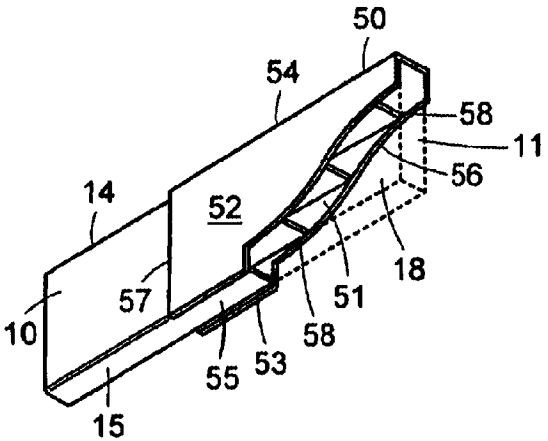
FIG. 4 is a perspective view of a template.
Figure 6:
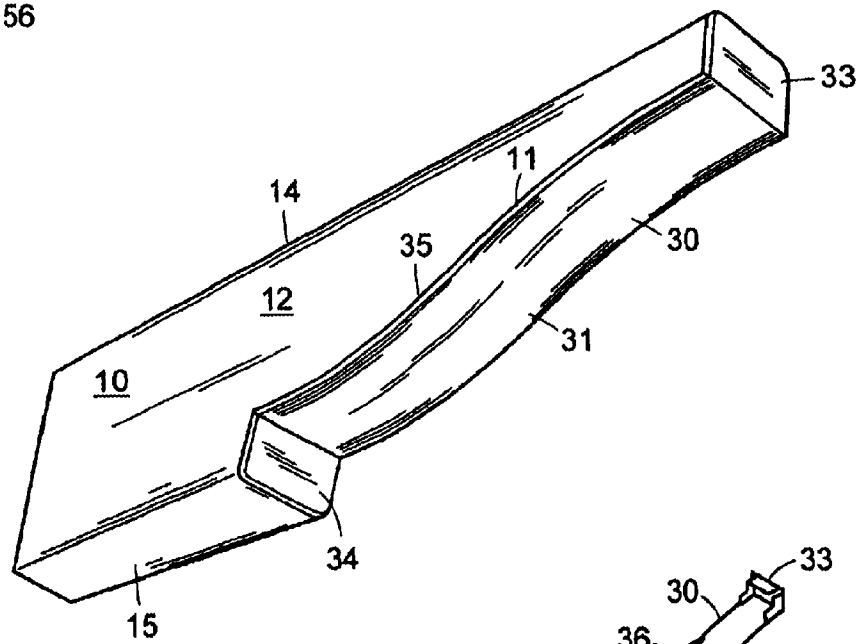
FIG. 6 is a shaped rectangular vinyl extrusion end with pergola end cap applied.
Figure 5A:
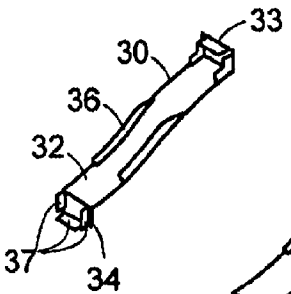
FIG. 5*a* is a perspective view of a 2×6 pergola end cap.
Figure 5B:
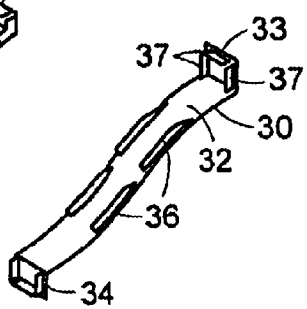
FIG. 5*b* is a perspective view of a 2×8 pergola end cap.
Figure 7:
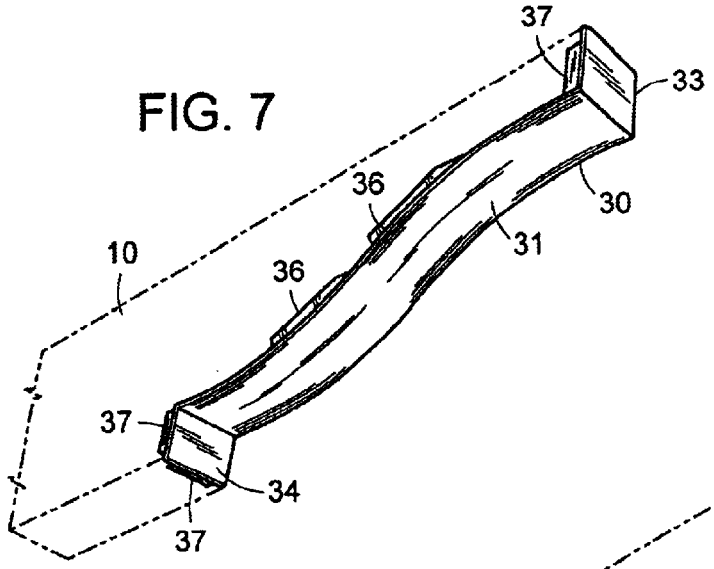
FIG. 7 is a perspective view of a 2×8 pergola end cap.
Figure 8:
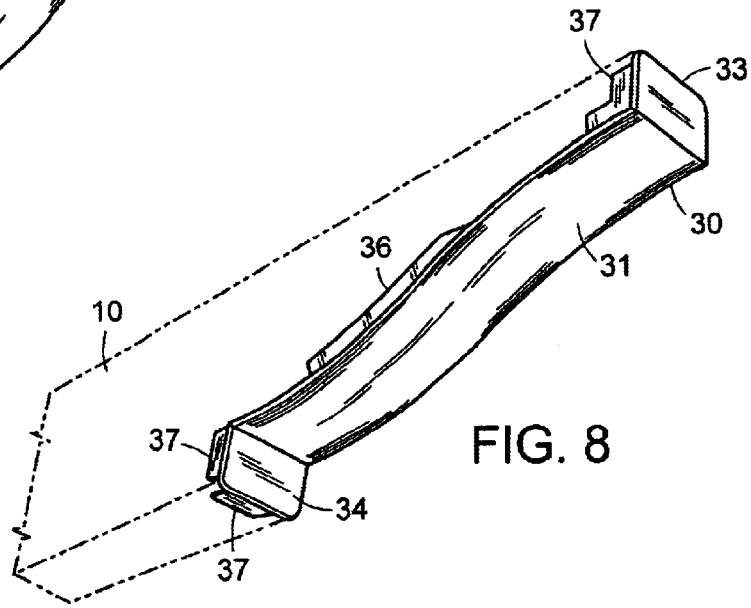
FIG. 8 is a perspective view of a 2×6 pergola end cap.
Figure 9:
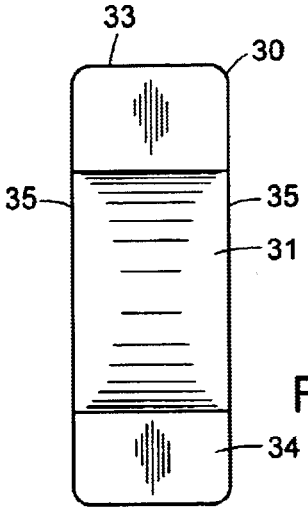
FIG. 9 is a front view of a 2×6 pergola end cap.
Figure 10:
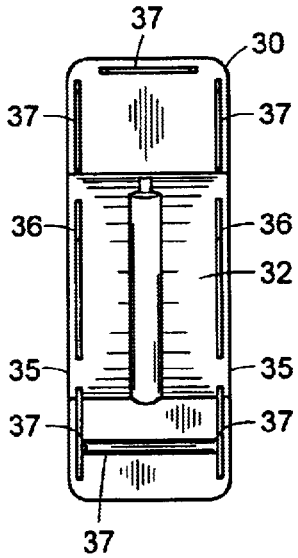
FIG. 10 is a rear view of a 2×6 pergola end cap.
Figure 13:
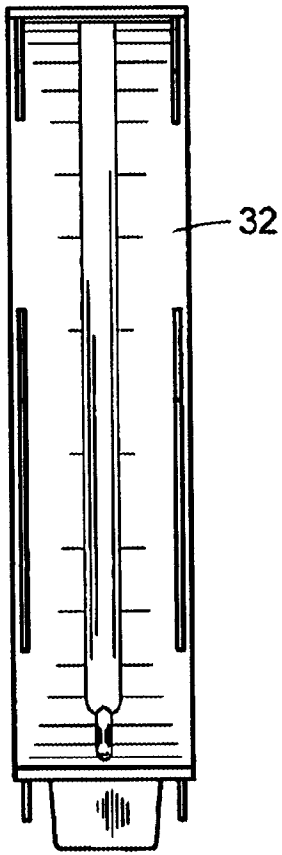
FIG. 13 is a top view of a 2×6 pergola end cap.
Figure 12:
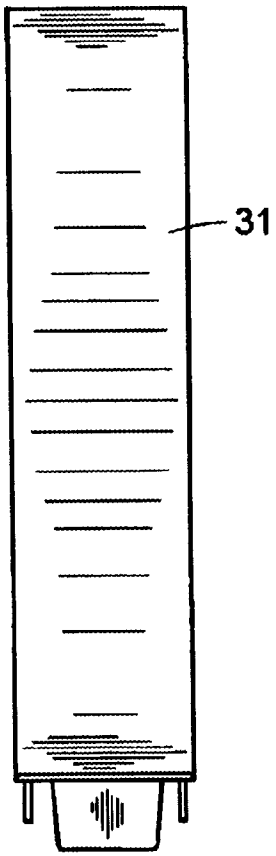
FIG. 12 is a bottom view of a 2×6 pergola end cap.
Figure 11:
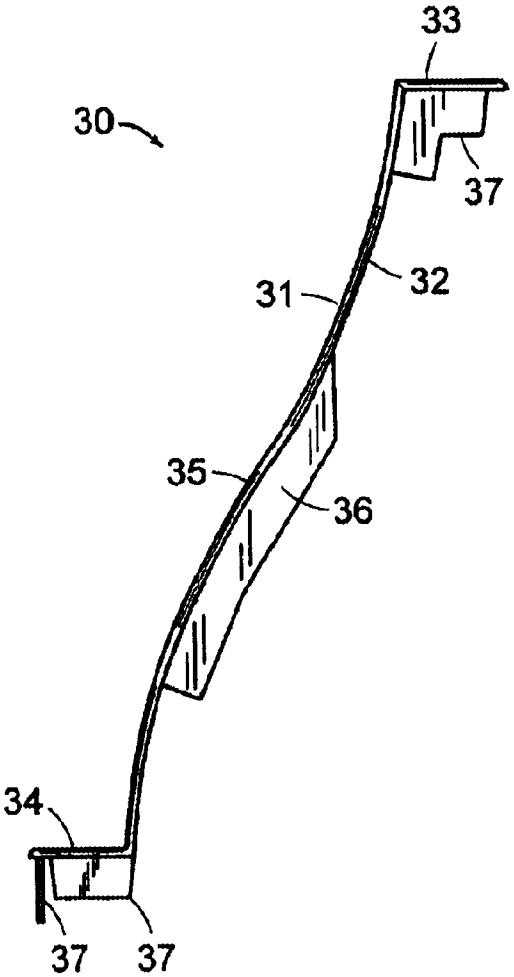
FIG. 11 is a side view of a 2×6 pergola end cap.
Figure 14:
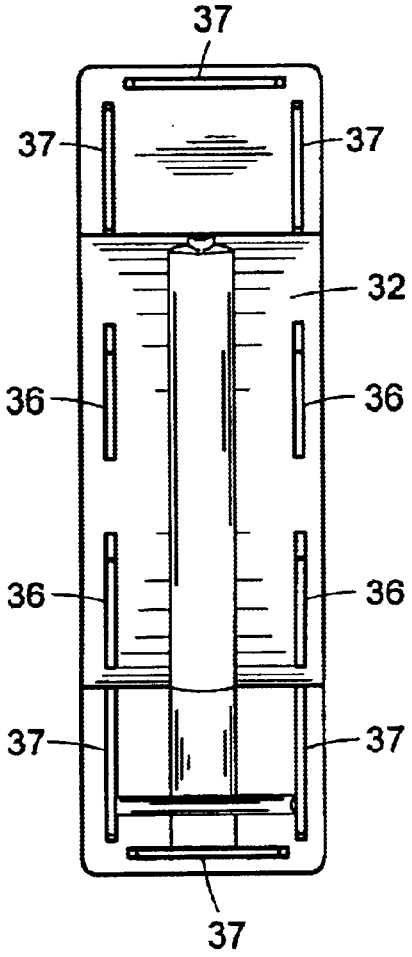
FIG. 14 is a rear view of a 2×8 pergola end cap.
Figure 15:
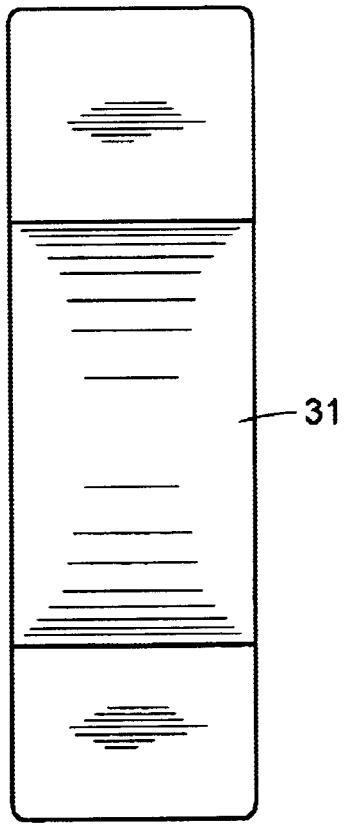
FIG. 15 is a front view of a 2×8 pergola end cap.
Figure 18:
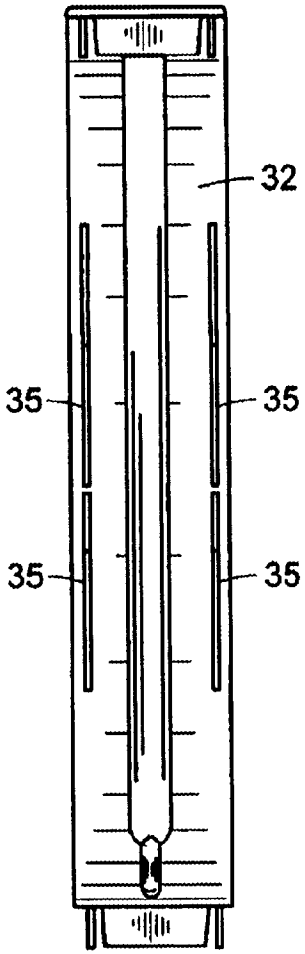
FIG. 18 is a top view of a 2×8 pergola end cap.
Figure 17:
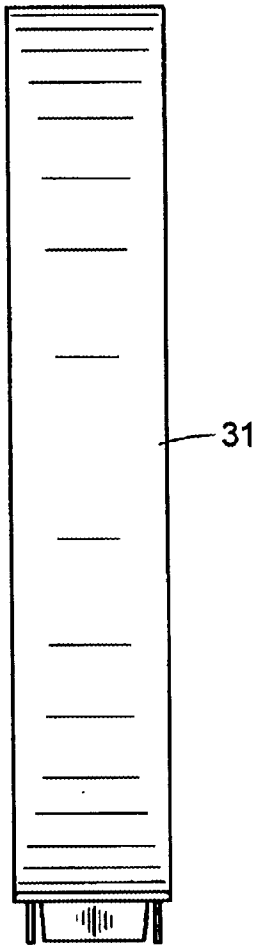
FIG. 17 is a bottom view of a 2×8 pergola end cap.
Figure 16:
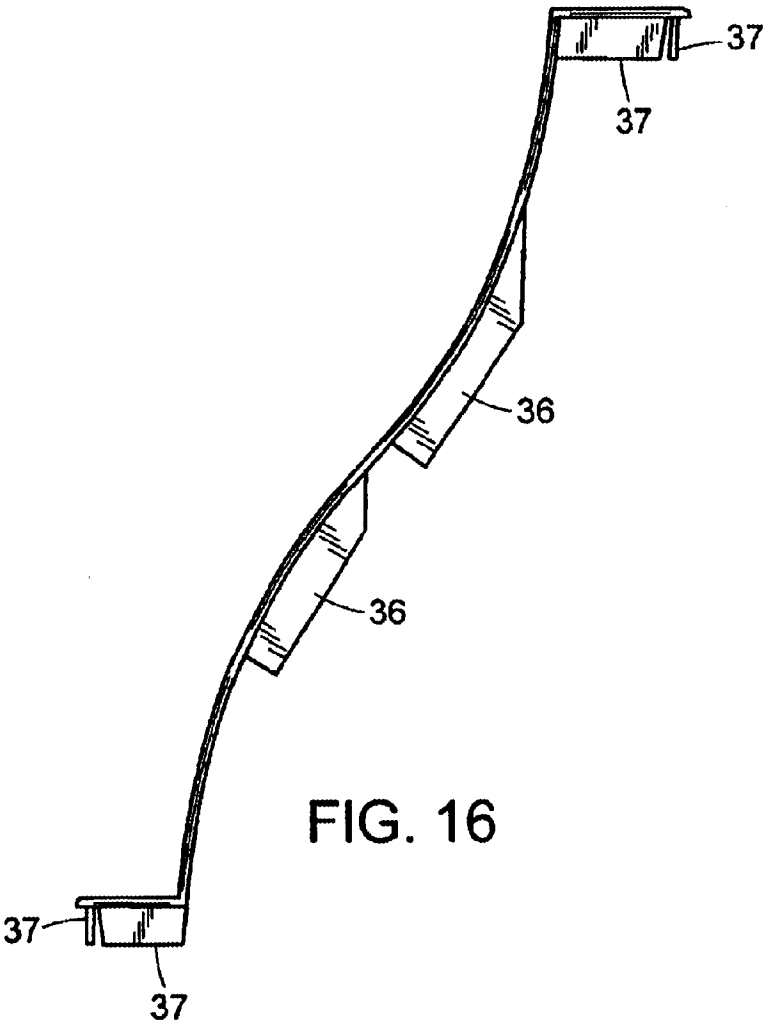
FIG. 16 is a side view of a 2×8 pergola end cap.

Referring to the drawings in detail wherein like elements are indicated by like numerals, there is shown a rectangular vinyl extrusion 10 before (FIG. 1) and after (FIG. 2) shaping. The extrusions 10 are major vinyl components used to form a pergola structure 1. Unlike wood, vinyl pergola elements must have their shapes assembled as opposed to simple mitering. A pergola is an arbor formed of horizontal trellis work supported on columns or posts. See FIG. 3. The pergola 1 has a trellis work "roof" 2 formed of horizontal carrying beams 3 and horizontal rafters 4. The beams 3 are supported by vertical posts 5. The beams 3 and rafters 4 are made from vinyl extrusions 10 with ends 11 which extend over the support posts 5 and carrying beams 3. The extrusion ends 11 are shaped prior to being formed into the pergola structure 1, typically by cutting with a CNC machine. Alternatively, a tool comprised of a template 50 may be fitted over the extrusion end 11 and the extrusion end 11 manually routed. See FIG. 4. A typical router used would be a laminate trimmer-style router with a collar or bearing able to follow the outline of the invention template. Each shaped extrusion end 11 then has an end cap 30 applied. See FIG. 5. Each end cap 30 is glued onto a shaped extrusion end 11. See FIG. 6. The end caps 30 may be preformed with a mold. Alternatively, a shaped end piece 60 as described in detail below may be preformed and then applied to an unshaped extrusion end 11.

Each extrusion 10 is comprised of a first side 12, an opposing second side 13, a top side 14 and a bottom side 15, said sides 12, 13, top side 14 and bottom side 15 defining an extrusion interior 16. The extrusion interior 16 has one or more internal bracing walls 17 perpendicularly joined to first side 12 and second side 13, said bracing walls 17 being parallel to said top side 14 and bottom side 15.

The invention template 50 has a first side 52, an opposing second side 53, a top side 54, an open bottom side 55, a forward, shaped end 56, and an open rear end 57, said sides 52, 53, top side 54, open bottom side 55, forward shaped end 56 and open rear end 57 defining a template interior 51. The template forward shaped end 56 may have side connectors 58, said side connectors being elongated, narrow elements connecting said first side 52 with said second side 53, thereby providing stiffening to the template 50. The template 50 is slid over the extrusion 10, template open rear end 57 over an extrusion end 11 first. The template 50 is then moved along the extrusion 10 until the top 54 of the template forward shaped end 56 is aligned with the top 14 of the extrusion end 11. The portion of the extrusion 10 protruding 18 forward of the template forward end 56 is then cut away. This results in an extrusion 10 with a shaped end 11'. See FIG. 2.

Figure 1:
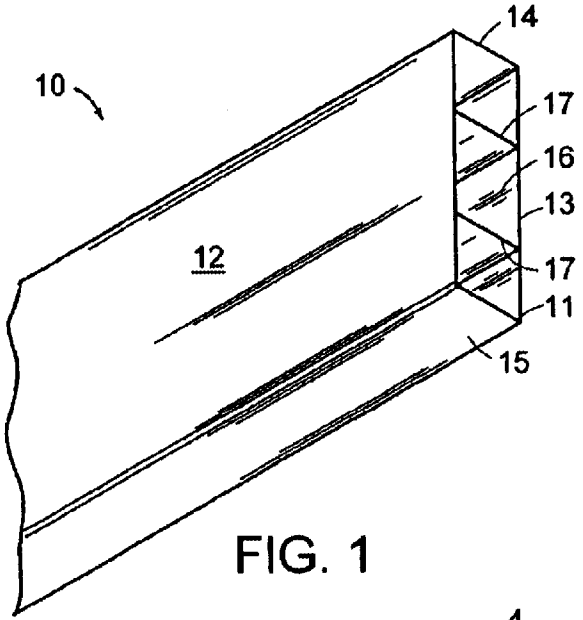
FIG. 1 is a rectangular vinyl extrusion before shaping.
Figure 2:
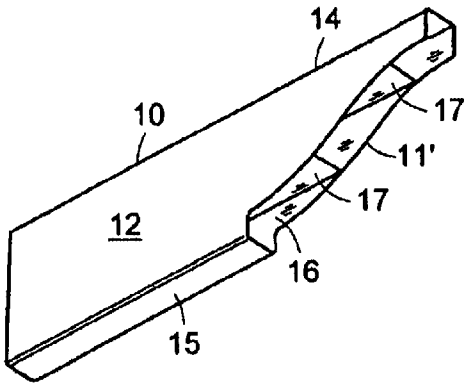
FIG. 2 is a rectangular vinyl extrusion after shaping.

An invention end cap 30 is then applied to the shaped extrusion end 11'. For purposes of exposition, applicant assumes that two cross-sectional sizes of extrusions will be used, i.e., 2×6 and 2×8. A 2×6 extrusion will generally have two bracing walls 17 as shown in FIGS. 1 and 2. A 2×8 extrusion will generally have three bracing walls 17. Each end cap 30 has an outside, forward side 31, an inside, rear side 32, a top portion 33, a bottom portion 34, and two opposite side edges 35. Each side edge has one or more rearwardly protruding shaped side flanges 36. The end cap top portion 33 and bottom portion 34 each have a rectangular arrangement of rearwardly protruding flanges 37. The rearwardly protruding flanges 36, 37 are adapted to engage the interior portions of the extrusion sides 12, 13, top 14 and bottom 15. The flanges 36, 37 are arranged to fit between and around the bracing walls 17. Each end cap 30 is placed against a shaped extrusion end 11' wherein the end cap inside, rear side 32 is positioned against the extrusion shaped end 11' and the flanges 36 into the extrusion interior 17, said end cap top portion 33 abutting the extrusion top 14 and said end cap bottom 34 portion abutting the extrusion bottom 15.

Figure 19:
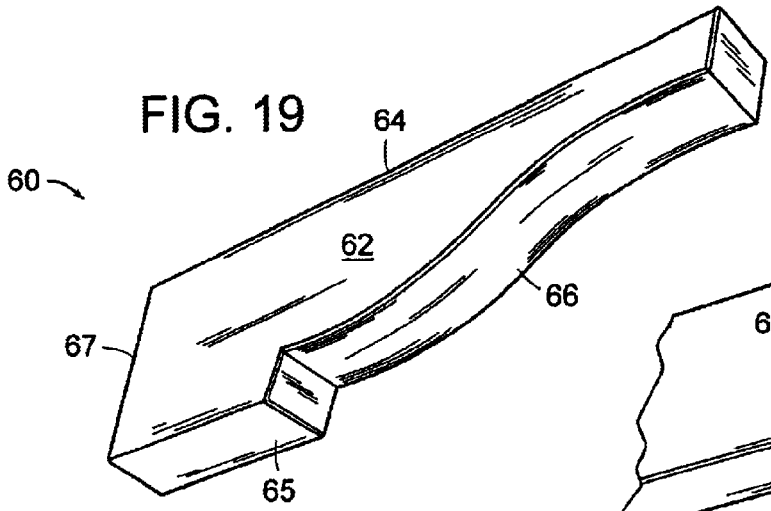
FIG. 19 is a front perspective view of a shaped end piece.
Figure 20:
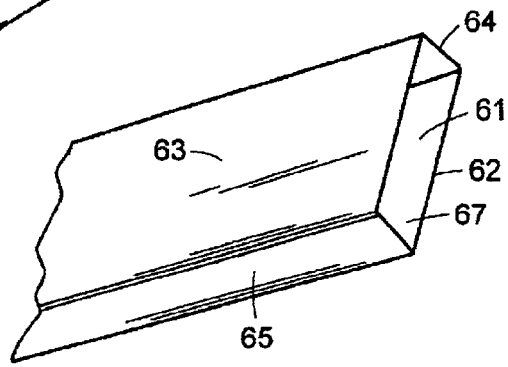
FIG. 20 is a rear perspective view, partly in section, of a shaped end piece.
Figure 21:
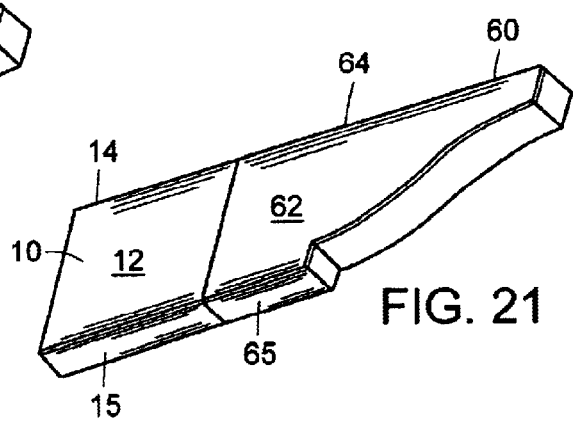
FIG. 21 is a front perspective view of the shaped end piece attached to an extrusion end.

Referring more particularly to FIGS. 19–21, in an alternate embodiment, a shaped end piece 60 may be preformed and then applied to an unshaped extrusion end 11. The shaped end piece 60 has a first side 62, an opposing second side 63, a top side 64, a bottom side 65, a forward, closed, shaped end 66, and an open rear end 67, said sides 62, 63, top side 64, bottom side 65, forward shaped end 66 and open rear end 67 defining an end piece interior 61. The shaped end piece forward end 66 may be formed as described above with an end cap 30 applied. The shaped end piece open rear end 67 is fitted against and joined to an unshaped extrusion end 11 as shown in FIGS. 1 and 21. The shaped end piece 60 has a cross section dimensionally equal to the cross section of the extrusion 10.

Figure 22:
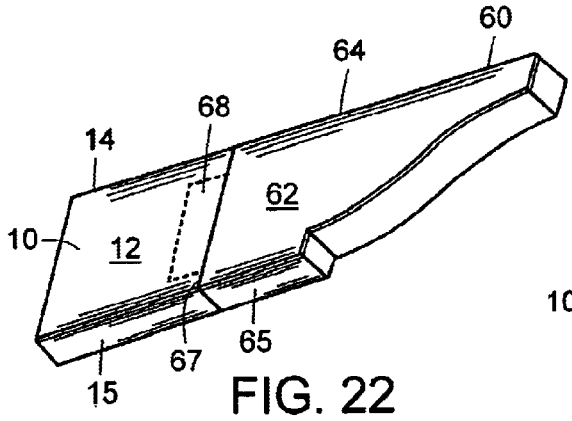
FIG. 22 is a front perspective view of the shaped end piece attached to an extrusion end by means of tabs.
Figure 23:
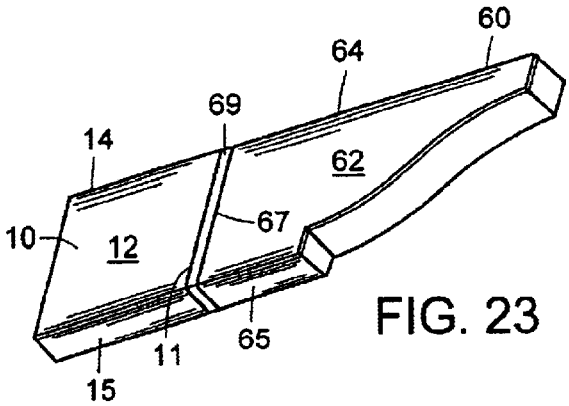
FIG. 23 is a front perspective view of the shaped end piece attached to an extrusion end by means of an external collar.

The shaped end piece 60 may be glued to the extrusion end 11 by means of tabs 68 protruding from the shaped rear end into the extrusion end interior 16. See FIG. 22. The heavy duty glue used fuses the vinyl pieces, i.e., extrusion 10 and shaped end piece 60, together. Alternatively, the shaped end piece 60 may be joined to the extrusion end 11 by means of an external collar 69 fitted about the seam formed by the extrusion end 11 and shaped end piece rear 67. See FIG. 23.

It is understood that the above-described embodiment is merely illustrative of the application. Other embodiments may be readily devised by those skilled in the art which will embody the principles of the invention and fall within the spirit and scope thereof.

I claim:

1. An end cap adapted for application to a shaped rectangular extrusion, said extrusion having a first side, an opposing second side, a top side and a bottom side, said sides, top side and bottom side defining an extrusion interior, said extrusion interior having a plurality of internal bracing walls perpendicularly joined to said first side and second side, said bracing walls being parallel to said top side and bottom side, said extrusion terminating in two shaped rectangular ends, said end cap comprising:

a curved outside forward side, a curved inside rear side, an upwardly extending top portion located at a first end of said forward side, a downwardly extending bottom portion located at a second end of said forward side, and two opposite side edges extending from said first end to said second end, said inside rear side adapted to being joined to an extrusion shaped rectangular end;

wherein each side edge has a plurality of rearwardly protruding shaped side flanges, said rearwardly protruding flanges being adapted to engage interior portions of the extrusion sides, top and bottom, said flanges being arranged to fit between and around the bracing walls.

2. An end cap as recited in claim 1, wherein:

said end cap top portion and bottom portion each have a rectangular arrangement of rearwardly protruding flanges, said rearwardly protruding flanges being adapted to engage interior portions of the extrusion sides, top and bottom.

3. An end cap as recited in claim 2, wherein:

said end cap is adapted to being placed against a shaped extrusion end wherein the end cap inside, rear side is positioned against the extrusion shaped end and the flanges into the extrusion interior, said end cap top portion abutting the extrusion top and said end cap bottom portion abutting the extrusion bottom.

4. A shaped end piece adapted for application to a rectangular extrusion, said extrusion having a first side, an opposing second side, a top side and a bottom side, said opposing sides, top side and bottom side defining an extrusion interior, said extrusion interior having a plurality of internal bracing walls perpendicularly joined to first side and second side, said bracing walls being parallel to said top side and bottom side, said extrusion terminating in two rectangular ends, comprising:

a first side, an opposing second side, a too side, a bottom side, a forward, closed, shaped end, and an open rear end, said sides, too side, bottom side, forward shaped end and open rear end defining an end piece interior, said end piece adapted to being fitted against said extrusion rectangular end and attached thereto;

a plurality of tabs extending from said open rear end into said extrusion interior and adapted to be glued to the extrusion first and second sides.

5. A shaped end piece adapted for application to a rectangular extrusion, said extrusion having a first side, an opposing second side, a top side and a bottom side, said opposing sides, top side and bottom side defining an extrusion interior, said extrusion interior having a plurality of internal bracing walls perpendicular joined to first side and second side, said bracing walls being parallel to said top side and bottom side, said extrusion terminating in two rectangular ends, comprising:

a first side, an opposing second side, a top side, a bottom side, a forward, closed, shaped end, and an open rear end, said sides, top side, bottom side, forward shaped end and open rear end defining an end piece interior, said end piece adapted to being fitted against said extrusion rectangular end and attached thereto;

an external collar adapted to be fitted about a seam formed by the extrusion end and shaped end piece rear.

* * * * *